US009526353B2

(12) United States Patent
Chubb

(10) Patent No.: US 9,526,353 B2
(45) Date of Patent: Dec. 27, 2016

(54) DOOR FOR A FREEZER CABINET

(71) Applicant: Richard Chubb, Voorhees, NJ (US)

(72) Inventor: Richard Chubb, Voorhees, NJ (US)

( * ) Notice: Subject to any disclaimer, the term of this patent is extended or adjusted under 35 U.S.C. 154(b) by 0 days.

(21) Appl. No.: 14/806,194

(22) Filed: Jul. 22, 2015

(65) Prior Publication Data

US 2016/0045038 A1 Feb. 18, 2016

Related U.S. Application Data

(60) Provisional application No. 62/027,283, filed on Jul. 22, 2014.

(51) Int. Cl.
*A47F 3/04* (2006.01)
*H05B 3/84* (2006.01)

(52) U.S. Cl.
CPC ..... *A47F 3/0434* (2013.01); *A47F 3/043* (2013.01); *H05B 3/84* (2013.01); *H05B 2203/013* (2013.01); *H05B 2203/014* (2013.01); *H05B 2203/016* (2013.01)

(58) Field of Classification Search
CPC ..... E06B 3/72; E05D 7/1011; F25D 23/02
USPC ..... 49/501, DIG. 1, DIG. 2
See application file for complete search history.

(56) References Cited

U.S. PATENT DOCUMENTS 3,114,944 A * 12/1963 Horgan, Jr. ..... E06B 3/4609 16/105
3,426,482 A * 2/1969 Mock ..... E06B 3/72 49/401
3,499,245 A * 3/1970 Richter ..... A47F 3/043 219/218
3,524,920 A * 8/1970 Heaney ..... H01B 1/00 174/250
3,673,735 A * 7/1972 Winsler ..... A47F 3/043 49/400
3,697,723 A * 10/1972 Winsler ..... A47F 3/043 219/218
3,949,526 A * 4/1976 Sherlock ..... E06B 3/221 49/501
4,080,756 A * 3/1978 Heaney ..... A47F 3/043 49/478.1
4,087,139 A * 5/1978 Heaney ..... E05B 1/0015 312/321.5
4,741,127 A * 5/1988 Bockwinkel ..... A47F 3/043 312/296
4,831,780 A * 5/1989 Bockwinkel ..... A47F 3/043 312/138.1
4,891,912 A * 1/1990 Bockwinkel ..... A47F 3/043 49/478.1
4,998,382 A * 3/1991 Kostos ..... A47F 3/043 49/501

(Continued)

*Primary Examiner* — Leslie A Nicholson, III
*Assistant Examiner* — Kimberley S Wright
(74) *Attorney, Agent, or Firm* — Francis C. Hand; Carella, Byrne, et al.

(57) ABSTRACT

A door for a refrigerated cabinet has an insulated glass unit of rectangular shape mounted in a pair of horizontally disposed aluminum rails and a pair of vertically disposed plastic rails connected to and across the pair horizontally disposed rails. A plastic breaker is mounted on each aluminum rail and a sealing gasket of open rectangular shape is mounted in each breaker and in each plastic rail to seal against a planar surface of the refrigerated cabinet in the closed position of the door.

15 Claims, 10 Drawing Sheets

(56) References Cited

U.S. PATENT DOCUMENTS 5,014,465 A * 5/1991 Ishikawa ..... E06B 3/88 49/417
5,016,949 A * 5/1991 Knurr ..... E05D 7/081 312/296
5,111,618 A * 5/1992 Kaspar ..... A47F 3/043 49/501
RE35,120 E * 12/1995 Heaney ..... E06B 3/6715 312/116
5,645,330 A * 7/1997 Artwohl ..... A47F 3/0426 312/116
5,910,083 A * 6/1999 Richardson ..... E06B 3/66366 312/116
6,148,563 A * 11/2000 Roche ..... A47F 3/0434 49/501
6,260,255 B1 * 7/2001 Richardson ..... A47F 3/0434 29/458
6,401,428 B1 * 6/2002 Glover ..... E06B 3/24 52/786.1
6,606,832 B2 * 8/2003 Richardson ..... A47F 3/125 312/116
6,637,093 B2 * 10/2003 Richardson ..... A47F 3/0434 29/458
6,655,766 B2 * 12/2003 Hodges ..... F25D 23/085 312/406.2
7,043,886 B1 * 5/2006 Chubb ..... A47F 3/0434 312/138.1
8,024,907 B2 * 9/2011 McKinlay ..... E06B 3/22 49/504
8,312,694 B2 * 11/2012 Hecht ..... F25D 23/02 312/116
8,776,443 B2 * 7/2014 Bienick ..... E05D 7/1011 49/501
8,869,493 B2 * 10/2014 Chubb ..... E06B 7/16 312/138.1
8,998,354 B2 * 4/2015 Wach ..... A47F 3/043 312/138.1
9,016,031 B2 * 4/2015 Chubb ..... E06B 7/16 312/138.1
9,157,675 B2 * 10/2015 Howington ..... F25D 21/04
2001/0003408 A1 * 6/2001 Otto ..... A47F 3/043 312/407
2003/0062813 A1 * 4/2003 Cording ..... A47F 3/0434 312/405
2003/0197449 A1 * 10/2003 Cording ..... A47F 3/0434 312/138.1
2004/0222724 A1 * 11/2004 Cording ..... A47F 3/0434 312/405
2006/0260229 A1 * 11/2006 McKinlay ..... E06B 3/22 52/204.593
2008/0122324 A1 * 5/2008 Bienick ..... E05D 7/1011 312/116
2008/0190046 A1 * 8/2008 Hecht ..... F25D 23/02 52/173.1
2009/0007587 A1 * 1/2009 Lanzl ..... A47F 3/0434 62/449
2009/0038231 A1 * 2/2009 Erbrect ..... E06B 7/14 49/476.1
2011/0043089 A1 * 2/2011 Chubb ..... A47F 3/0434 312/405.1
2011/0089802 A1 * 4/2011 Cording ..... A47F 3/0434 312/405
2013/0239484 A1 * 9/2013 Chubb ..... E06B 7/16 49/70
2013/0285517 A1 * 10/2013 Wach ..... A47F 3/043 312/114
2015/0020451 A1 * 1/2015 Chubb ..... E06B 7/16 49/70
2015/0054396 A1 * 2/2015 Trulaske, Sr. ..... F25D 23/028 312/405

* cited by examiner

FIG. 14
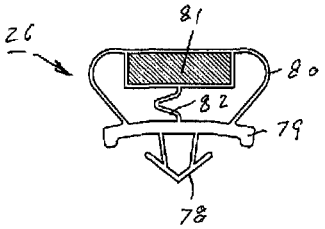
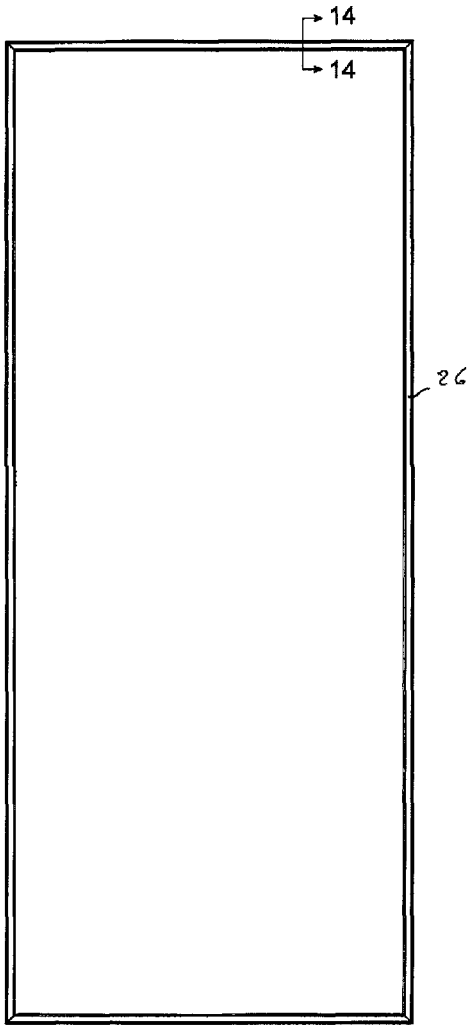
FIG. 13

DOOR FOR A FREEZER CABINET

This application claims priority of US Provisional Patent Application 62/027,283 filed Jul. 22, 2014.

This invention relates to a door for refrigerated cabinets.

As is known various types of doors have been provided for mounting on refrigerated cabinets. In some cases, the doors have been provided with glass units over a substantial portion of the front of the doors to permit easy viewing of the contents within the cabinets. For example, U.S. Pat. No. 7,043,886 provides a door assembly for commercial refrigerators and freezers that includes an insulating glass unit made up of two or more glass panes maintained in spaced-apart relation by tubular spacers with the interior between the panes appropriately sealed.

Because insulated glass doors are relatively heavy and require a sturdy and rigid frame for supporting their weight and for withstanding abusive repeated openings and closings that occurs in commercial establishments, the glass unit is supported within a relatively rigid outer metallic frame, commonly formed from aluminum extrusions, with the metal frame overlapping the periphery of the glass unit for retaining the glass unit in position and for providing a decorative finished appearances to the door assembly. While improvements in energy efficiencies, structural rigidity, and mounting of such door assemblies have taken place over the years, such insulated glass door assemblies have remained substantially unchanged.

U.S. Pat. No. 6,148,563 describes a reach-in door having a finished molded door frame of a suitable material such as injection molded polyurethane that does not require a metal frame or covering of any type.

Other types of doors for refrigerated cabinets use heavy, bulky structural extrusions to accomplish a full-perimeter door framing system—these are typically aluminum (for strength), coupled with heavy PVC breakers to attempt to isolate the aluminum from the cold interior air inside the refrigerator—they often use perimeter heater wires inside the doors to prevent external condensation.

Accordingly, it is an object of the invention to provide a state-of-the-art, energy-efficient, higher-product-visibility, lightweight, low-cost, easy-to-install, modular door for commercial refrigerator applications.

Briefly, the invention provides a door for a refrigerated cabinet having a planar peripheral surface about a compartment for receiving goods that require refrigeration.

In accordance with the invention, the door is hinged to the cabinet for movement between a closed position relative to the planar peripheral surface and an open position spaced from the planar peripheral surface to allow access to the refrigerated compartment and the goods therein.

The door includes an insulating glass unit ("IGU") of rectangular shape, a multi-piece frame about the IGU of aluminum rails and plastic stiles, a plastic breaker mounted on each aluminum rail facing the refrigerated cabinet and a sealing gasket mounted in the breakers and plastic stiles to seal against the planar peripheral surface of the refrigerated cabinet in the closed position of said door.

The aluminum rails of the multi-piece frame number two and are horizontally disposed with each rail having a first channel receiving a respective edge, i.e. the top and bottom edges, of the IGU and a second channel facing the refrigerated cabinet.

Each plastic breaker is mounted in the second channel of a respective aluminum rail and has a recess facing away from the respective aluminum rail to receive the sealing gasket.

The plastic stiles of the multi-piece frame number two and are vertically disposed and connected to and across the horizontally disposed rails. Each vertically disposed plastic stile has a channel for receiving a respective edge, i.e. a side edge, of the IGU and a recess facing the refrigerated cabinet to receive the sealing gasket.

The sealing gasket is of open rectangular shape to be mounted in the recess of each plastic breaker and in the recess of each plastic rail in order to seal against the planar peripheral surface of the refrigerated cabinet in the closed position of the door.

In addition, each aluminum rail is provided with a pocket that opens into the two channels of the rail so that a rigid urethane or similar low-thermal conductivity type material can be poured or inserted into the pocket to form a structural, low-conductivity thermal break to reduce or eliminate the formation of condensation on the outer surfaces of the door, i.e., the side of the door which faces into a store or market area.

Also, a steel or other type of low-profile, high-strength stiffener can be mounted in the channel of each vertical plastic stile as needed for strengthening the door and for reducing bending or bow in the door.

These and other objects and advantages of the invention will become more apparent from the following detailed description taken in conjunction with the accompanying drawings wherein:

FIG. 13 illustrates a front view of the sealing gasket of the door of FIG. 1; and FIG. 14 illustrates a view taken on line 14-14 of FIG. 13

Figure 1:
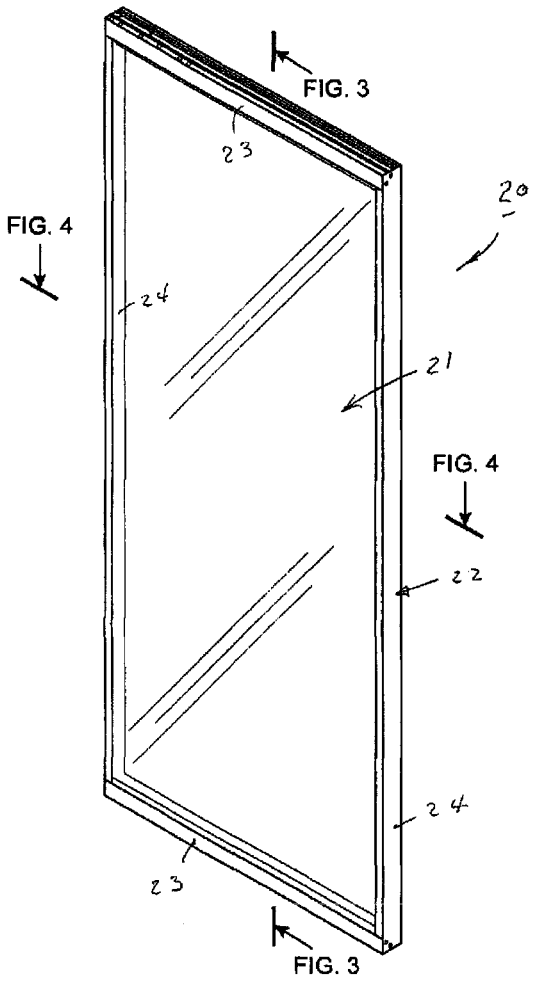
FIG. 1 illustrates a perspective view of a door constructed in accordance with the invention.
Figure 2:
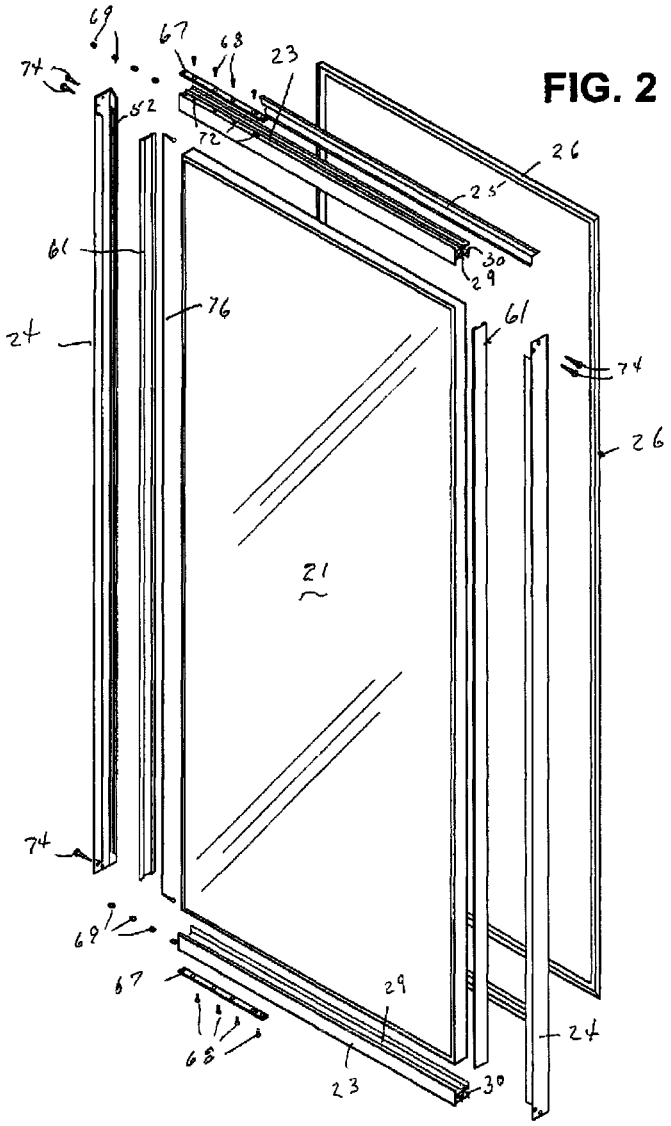
FIG. 2 illustrates an exploded view of the door of FIG. 1.

Referring to FIGS. 1 and 2, the door 20 includes an insulating glass unit (IGU) 21 of rectangular shape and a multi-piece frame 22 about the IGU of aluminum rails 23 and plastic stiles 24.

Referring to FIG. 2, a plastic breaker 25 is mounted via snap-on installation technique, i.e., no fasteners required, on each aluminum rail 23 and a sealing gasket 26 is mounted in the plastic breakers 25 and plastic stiles 24.

Figure 3:
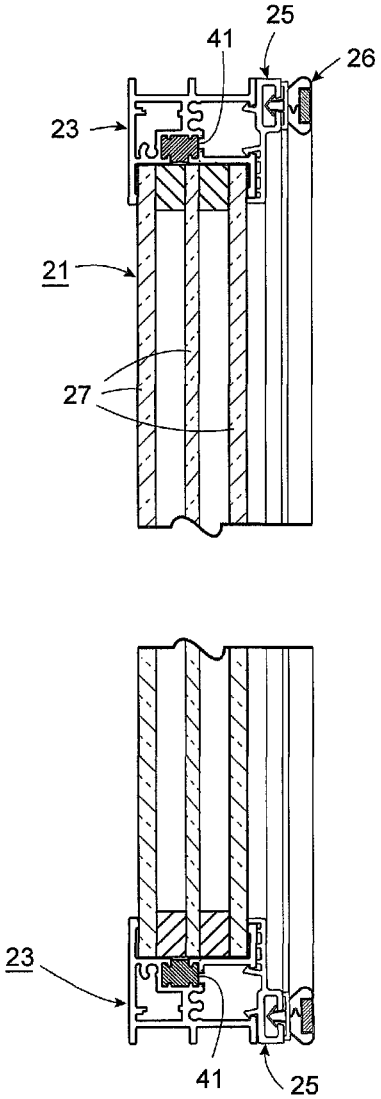
FIG. 3 illustrates a view taken on line 3-3 of FIG. 1.

Referring to FIG. 3, the IGU 21 is constructed in a conventional manner, for example, having three glass panes 27 and a perimeter spacer system 28 maintaining the glass panes 27 in parallel spaced apart relation. The IGU can be electrically-heated or standard, and the rails and stiles can also include perimeter anti-condensate heaters between the IGU and the rails or stiles.

Referring to FIGS. 2 and 3, the aluminum rails 23 are horizontally disposed with each rail 23 having a first channel 29 receiving a respective edge, i.e. the top or bottom edge, of the IGU 21 and a second channel 30 receiving a plastic breaker 25.

Figure 6:
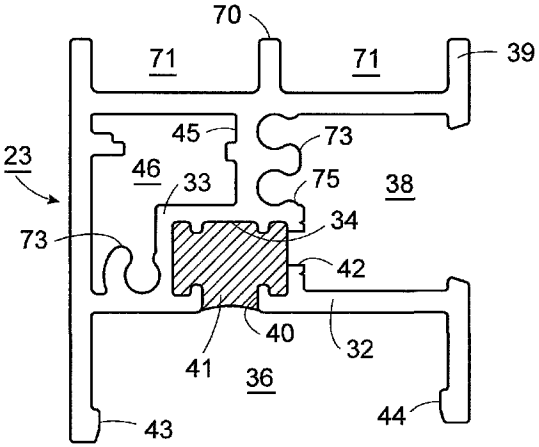
FIG. 6 illustrates a cross-sectional view of a thermally-broken, urethane-debridged horizontal aluminum rail of the door of FIG. 1.

Referring to FIG. 6, each aluminum rail 23 is formed as an extrusion and includes a side wall 31 (the "front wall" or "vision surface" of the aluminum rail, facing the store-side of a grocery store, etc.) and a contoured first web 32 that extends perpendicularly from the side wall 31. This contoured web 32 includes a shaped intermediate section 33 that forms a pocket 34 and a flange 35 that extends from and perpendicularly of the first web 32 to define a first, IGU-facing channel 36 for receiving a respective edge of the IGU 21 (not shown).

A second web 37 extends perpendicularly from the side wall 31 to define a second channel 38 with the first web 32 and a second flange 39 extends from and perpendicularly from the second web 37.

The shaped intermediate section 33 has a slot 40 that opens into the pocket 34 and extends along the length of the aluminum rail 23 (see FIG. 10) and a urethane thermally-insulating material 41 is installed/injected in the pocket 34 to form a thermal break to reduce or eliminate condensation on the outer side of the door 10, e.g. the side facing into a store or market area. After the urethane pour is completed and has fully-cured, a second slot 42 is cut in the intermediate section 33, as by a saw blade (typically on a table saw) to bifurcate the wall facing the channel 38 causing the extrusion to become "thermally-debridged"—i.e., "isolating" the cold side from the warm side of the extrusion.

As illustrated, the end edge 43 of the side wall 31 and the end edge 44 of the first flange 35 that define the channel 36 for receiving the IGU 21 (not shown) are each rounded to provide for ease of installation over the edge of the IGU 21 when assembling the door 20.

In addition, each aluminum rail 23 has a partition 45 intermediately of and connected between shaped intermediate sections 33 of the first web 32 and the second web 37 to define the second channel 38 and to define a closed chamber 46 with the side wall 31, first web 32 and second web 37.

Referring to FIG. 2, each horizontal plastic breaker 25 is of a length to extend longitudinally over the entire length of an aluminum rail 23 and is of skeletal cross-sectional shape.

Figure 7:
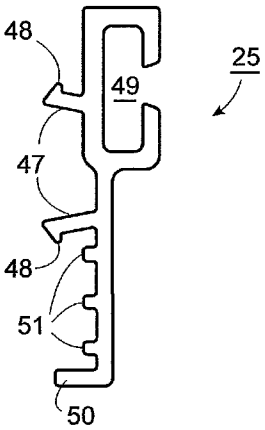
FIG. 7 illustrates a cross-sectional view of a horizontal plastic breaker of the door of FIG. 1.

As illustrated in FIG. 7, each breaker 25 has a pair of resilient tangs 47 that are sized to fit into the second channel 38 of an aluminum rail 23 and to resiliently engage against the flanges 35 and 39 of the aluminum rail 23. As indicated, each tang 47 has a small foot 48 that snaps over an end of a respective flange 35, 39 of the rail 23 to retain the breaker 25 in place when mounted in the rail 23.

Each breaker 25 also has a box-shaped end defining a recess 49 open to the side of the breaker 25 and facing away from a respective aluminum rail 23 in order to receive the sealing gasket 26 (see FIG. 3).

Each breaker 25 also has a flange 50 at the end opposite the box-shaped end that is sized to fit over the flange 33 of an aluminum rail 23 as shown in FIG. 3 and to abut the IGU 21.

A plurality of ribs 51, for example three ribs, are provided on each horizontal PVC breaker 25 on the side of the flange 50 in order to create additional dead air pockets/insulation between the PVC breaker 25 and the cold-side surface of the flange 39 of the horizontal rail extrusion 23.

Referring to FIG. 2, the vertical plastic stiles 24 are vertically disposed with each stile 24 being connected to and across the pair of horizontally disposed aluminum rails 23.

Figure 4:
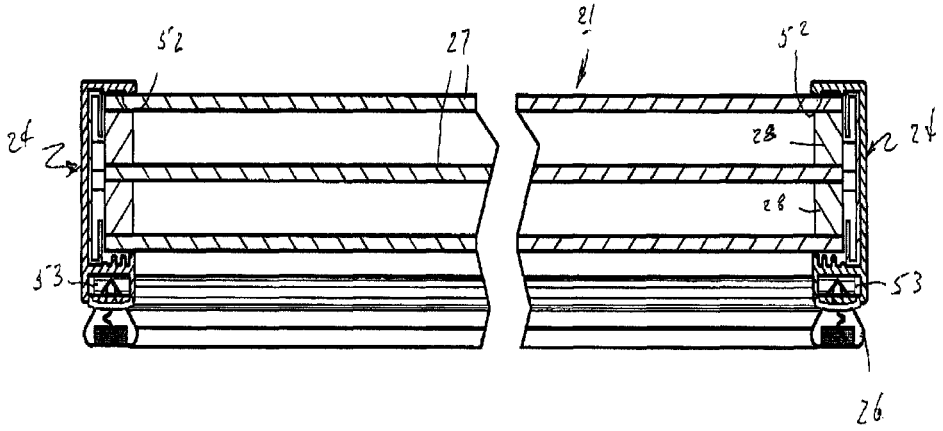
FIG. 4 illustrates a view taken on line 4-4 of FIG. 1.

Referring to FIG. 4, each vertical plastic stile 24 has a channel 52 that extends longitudinally over the length of the stile 24 to receive a side edge of the IGU 21 and a recess 53 that extends longitudinally over the length of the stile 24 to receive the sealing gasket 26.

Figure 8:
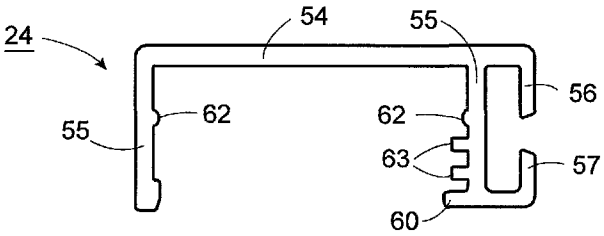
FIG. 8 illustrates a cross-sectional view of a vertical plastic stile/breaker of the door of FIG. 1.

Referring to FIG. 8, each vertical plastic stile 24 has a base 54 (or exterior wall), a pair of parallel walls 55 extending perpendicularly of the base 54 to define the U-shaped channel 52, a flange 56 extending perpendicularly from the base 54 and an L-shaped flange 57 extending from one of the walls 55 to define the recess 53 with the flange 56.

As illustrated, one wall 55 has a rounded edge 59 while the opposite wall 55 has a flange 60 with a rounded edge to provide for ease of installation over the edge of the IGU 21 when assembling the door 20, and contains a small lip facing the IGU to help retain sealant used during assembly from oozing out from under the plastic walls 55.

Referring to FIGS. 2 and 4, each vertical plastic stile 24 has a steel (or other high-strength, low-thermal-conductivity) stiffener 61 mounted in the channel 52 thereof to strengthen the vertical stile 24 and door 20 against bending or bow during use.

Referring to FIG. 8, each wall 55 of the vertical plastic stiles 24 has a projection 62 facing a projection 62 of the opposite wall to contain a stiffener 61 (not shown) within the channel 52.

In addition, a plurality of ribs 63, for example two ribs, are provided on the wall 55 defining the recess 59 in order to enhance sealing area between the IGU and the vertical PVC stile, and to reduce the amount of sealant required to fill the space between the interior wall 55 and the IGU.

Figure 5:
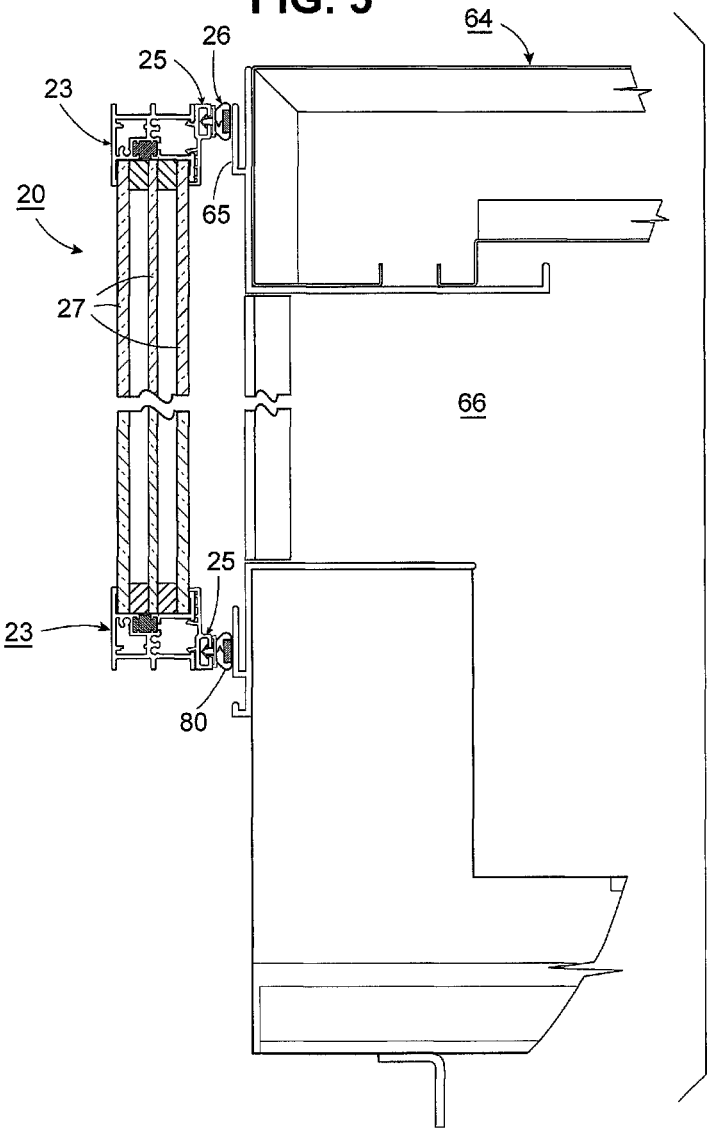
FIG. 5 illustrates a broken view of the door of FIG. 1 as mounted on a refrigerated cabinet in accordance with the invention.

Referring to FIG. 5, wherein like reference characters indicate like parts as above, the door 20 is constructed to be used with a refrigerated cabinet 64 having a planar peripheral surface 65 formed by any suitable structure about a compartment 66 for receiving goods that require refrigeration. To this end, the door 20 is hinged to the cabinet 64 for movement between a closed position relative to the planar peripheral surface 65 (as shown) and an open position spaced from the planar peripheral surface 65 (not shown).

Referring to FIG. 1, any suitable hinge mechanism (not shown) may be used to hinge the door 20 in place. For example, as indicated in FIG. 2, the aluminum rails 23 at the top and bottom of the door 20 are provided with high-strength hinge plates 67 that are secured in place by threaded machine screws 68 into slab based weld nuts 69 that slide into the hollow cavity 41 of a rail 23.

The high-strength steel hinge brackets or hinge plates 67 that attach to the top and bottom horizontal aluminum rails 23 are able to resist the high-torque that an outside-mounted cartridge door closer could create on these hinge brackets. By using an exterior-to-door-mounted cartridge door closer, the edge-of-door construction can be extremely narrow to achieve an extremely "high-visibility" look of the door, which is characterized by narrow vertical stiles that cover the insulating system at the edge of the IGU 21.

Figure 9:
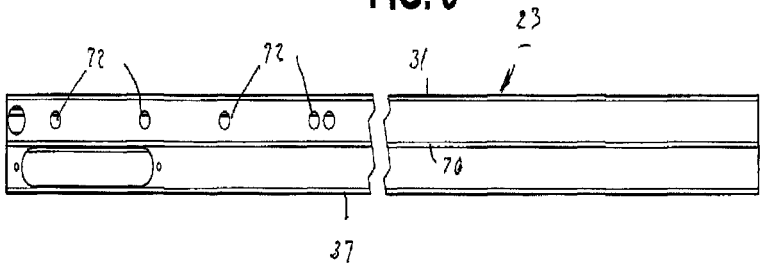
FIG. 9 illustrates a top view (or exterior view) of the horizontal aluminum rail at the top edge of the door of FIG. 1.

Referring to FIGS. 6 and 9, each aluminum rail 23 has an outstanding rib 70 on the web 35 that define two channels 71 with the side wall 31 and flange 37 in order to stiffen the rail 23 and to provide space to receive the hinge plates 67. As indicated, holes 72 are provided for the bolts 68 that are to secure the hinge plates 67 in place.

Figure 10:
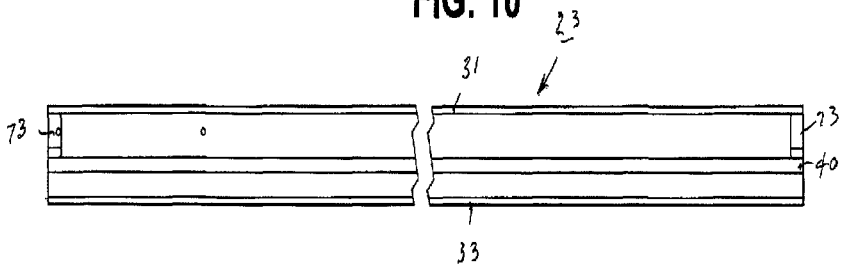
FIG. 10 illustrates a bottom view (or interior view) of the horizontal, top-edge aluminum rail of FIG. 9.

Referring to FIGS. 6 and 10, each aluminum rail 23 has a pair of ears 73 at each end for receiving a pair of threaded screws 74 (see FIG. 2) that serve to secure an end of a vertical plastic stile 24 to an end of an aluminum rail 23.

Figure 11:
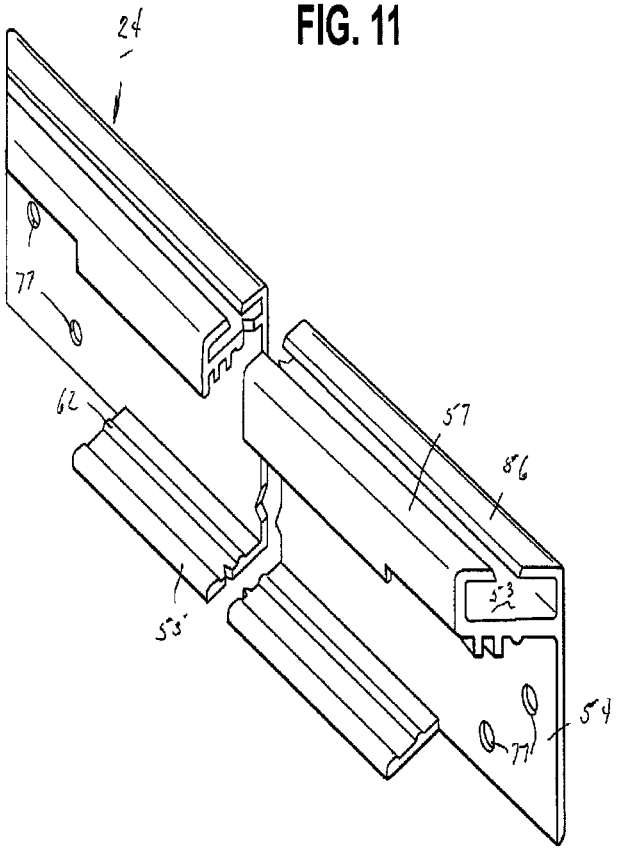
FIG. 11 illustrates a perspective view of the fabricated vertical plastic stile of the door of FIG. 1.
Figure 12:
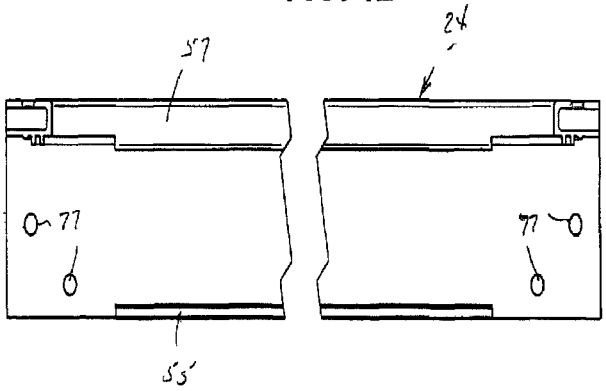
FIG. 12 illustrates a side view of the plastic rail of FIG. 11.

Each aluminum rail 23 also has a channel 75 extending along the length of the rail 23 to receive a resistive heater wire 76 (see FIG. 2) for heating of the door 20, when extreme environmental condition require supplemental rail heat. Referring to FIGS. 11 and 12, each plastic stile 24 has a pair of holes 77 at each end for passage of the screws 74 (see FIG. 2) into the ends of the aluminum stile 24.

In addition, the front wall 55 of the stile 24 is terminated short of the end of the stile 24 to accommodate fitting of an aluminum rail 23 against the base 54 of the stile 24 and the flanges 56, 57 are mitered to engage against like mitered ends (not shown) of the breakers 25. The stiles 24 have a notched and mitered end so as to allow the magnetic bulb seal 26 to seat properly all the way around, and to allow the horizontal PVC breaker 25 to cover over the horizontal aluminum rail 23 where the rail 23 slides "under" the vertical PVC stile 24 at the ends of the rails 23.

When the door 20 is assembled, the box-shaped end defining a recess 49 in each horizontal plastic breaker 25 and flanges 56, 57 defining the recess 53 in each vertical plastic stile 24 are co-planar and receive the one piece sealing gasket 26 in a smooth uninterrupted manner.

Referring to FIGS. 13 and 14, the sealing gasket 26 is of conventional type. For example, the sealing gasket 26 includes a mounting tang 78 for fitting into the recess 49 of a breaker 25 and a recess 54 of a plastic rail 24. In addition, the gasket seal 26 has a body 79 from which the tang 78 projects and a deformable membrane 80 that is to engage and seal against the planar surface 65 of a cabinet 64 (See FIG. 5).

A magnet 81 is also disposed within the membrane 80 to be attracted to any metal in or on the planar surface 65 and a spring 82 serves to bias the magnet 81 and membrane 80 outwardly of the body 79.

The IGU 21 may include a transparent electrically conductive heating film bonded to at least one of panes 27 and a pair of electrically conductive bus bars mounted in electrical contact on the heating film on opposite sides of the pane 27.

What is claimed is:

1. A door for a refrigerated cabinet comprising an insulated glass unit of rectangular shape, said unit having three glass panes and a perimeter spacer system maintaining said glass panes in parallel spaced apart relation; and a pair of horizontally disposed aluminum rails, each said rail having a side wall, a first web extending perpendicularly from said side wall, a first flange extending from and perpendicularly of said first web to define a first channel for receiving a respective edge of said insulated glass unit, a second web extending perpendicularly from said side wall to define a second channel with said first web and a second flange extending from and perpendicularly of said second web;

a pair of plastic breakers, each said breaker being mounted on a respective aluminum rail in abutment with said first flange and said second flange thereof and having a first recess therein facing away from said respective aluminum rail;

a pair of vertically disposed plastic rails connected to and across said pair of horizontally disposed rails to define a frame, each said vertically disposed plastic rail having a base, a pair of parallel walls extending perpendicularly of said base to define a third channel for receiving a respective edge of said insulated glass unit, a third flange extending perpendicularly from said base and an L-shaped flange extending from one of said walls of said plastic rail to define a second recess with said third flange; and a sealing gasket of open rectangular shape mounted in said first recess of each said breaker and in said second recess of each said plastic rail.

2. A door as set forth in claim 1 wherein each said aluminum rail has a partition intermediately of and connected between said first web and said second web to define said second channel and to define a closed chamber with said side wall, said first web and said second web.

3. A door as set forth in claim 2 wherein said partition forms a pocket opening into said first channel and said second channel and a urethane block is mounted in said pocket.

4. A door as set forth in claim 1 wherein each said breaker has a pair of resilient tangs fitting into said second channel and resiliently engaging against said first flange and said second flange.

5. A door as set forth in claim 1 wherein said first recess in each said breaker and said second recess in each said plastic rail are co-planar.

6. A door as set forth in claim 1 further comprising a pair of steel stiffeners, each said stiffener being mounted within a respective plastic rail.

7. A door as set forth in claim 6 wherein each wall of said pair of parallel walls of each said plastic rail has a projection facing a projection of the opposite wall of said pair of walls to contain a respective stiffener within said third channel.

8. A door as set forth in claim 1 wherein each said plastic rail extends between and is secured to said horizontal rails to define a frame of rectangular cross-section about said insulated glass unit.

9. A door as set forth in claim 1 further comprising a heater wire mounted in each of a respective one of said pair of horizontally disposed rails and a respective one of said pair of vertically disposed rails.

10. A door as set forth in claim 1 wherein said insulated glass unit further comprises a transparent electrically conductive heating film bonded to at least one of said panes and a pair of electrically conductive bus bars mounted in electrical contact on said heating film on opposite sides of said pane.

11. In combination a refrigerated cabinet having a planar peripheral surface about a compartment therein; and a door hinged to said cabinet for movement between a closed position relative to said planar peripheral surface and an open position spaced from said planar peripheral surface, said door including an insulated glass unit of rectangular shape, a pair of horizontally disposed aluminum rails, each said rail having a first channel receiving a respective edge of said insulated glass unit and a second channel facing said refrigerated cabinet, a pair of plastic breakers, each said breaker being mounted on a respective aluminum rail and having a first recess therein facing away from said respective aluminum rail;

a pair of vertically disposed plastic rails connected to and across said pair of horizontally disposed rails, each said vertically disposed plastic rail having a third channel for receiving a respective edge of said insulated glass unit and a second recess facing said refrigerated cabinet; and a sealing gasket of open rectangular shape mounted in said first recess of each said breaker and in said second recess of each said plastic rail, said sealing gasket being disposed to seal against said planar peripheral surface of said refrigerated cabinet in said closed position of said door.

12. The combination as set forth in claim 11 wherein each said aluminum rail includes a side wall, a first web extending perpendicularly from said side wall, a first flange extending from and perpendicularly of said first web to define said first channel, a second web extending perpendicularly from said side wall to define said second channel with said first web.

13. The combination as set forth in claim 12 wherein each said aluminum rail includes a partition intermediately of and connected between said first web and said second web to define said second channel and to form a pocket opening into said first channel and said second channel.

14. The combination as set forth in claim 13 further comprising a urethane block mounted in said pocket of each said aluminum rail to form a thermal break thereat.

15. The combination as set forth in claim 11 further comprising a pair of steel stiffeners, each said steel stiffener being mounted in said third channel of a respective plastic rail to strengthen said door in bending.

* * * * *